US005827165A

United States Patent [19]

Achelpohl et al.

[11] Patent Number: 5,827,165

[45] Date of Patent: Oct. 27, 1998

[54] DEVICE FOR PULLING OPEN CONTINUOUSLY CROSS-CONVEYED TUBE SECTIONS FOR THE PURPOSE OF FORMING BOTTOMS IN THE MANUFACTURE OF SACKS

[75] Inventors: Fritz Achelpohl, Lienen; Rüdiger Duwendag; Joachim Witzke, both of Lengerich, all of Germany

[73] Assignee: Windmöller & Hölscher, Lengerich/Westf., Germany

[21] Appl. No.: 727,965

[22] Filed: Oct. 10, 1996

[30] Foreign Application Priority Data

Oct. 27, 1995 [DE] Germany ..... 195 40 150.6

[51] Int. Cl.[6] ..... B31B 1/80

[52] U.S. Cl. ..... 493/256; 493/313

[58] Field of Search ..... 493/308, 309, 493/313, 316, 317, 315, 256

[56] References Cited

U.S. PATENT DOCUMENTS 2,224,646 3/1940 Robinson .
3,446,121 5/1969 Achelpohl .

FOREIGN PATENT DOCUMENTS 1 561 467 3/1971 Germany .
2 144 906 3/1972 Germany .
82 34 461 6/1983 Germany .
39 37 536 5/1990 Germany .
1 240 300 7/1971 United Kingdom .

*Primary Examiner*—Jack W. Lavinder
*Attorney, Agent, or Firm*—Evenson, McKeown, Edwards & Lenahan, PLLC

[57] ABSTRACT

A device for pulling open continuously cross-conveyed tube sections for the purpose of forming bottoms in the manufacture of sacks has support tubes provided in pairs and connected to vacuum sources by lines. Each of the support tubes forms the coupler of two parallel connecting rods housed in a machine frame so as to rotate and is equipped with a row of radial suction units. A crank is connected to a shaft of a parallel connecting rod. A crank pin, supporting a slide ring or a roll, slides in a radial guide attached to a shaft. The shaft of the guide is offset relative to the parallel connecting rod shaft such that an essentially translational movement corresponding to the conveyance speed is superimposed on the opening movement of the row of suction units. In order to achieve a better opening of the tube section ends even at higher conveyance speeds, the radial guide is formed in a curved shape such that the time of uniform motion of the suction units and the tube section is lengthened.

6 Claims, 3 Drawing Sheets

DEVICE FOR PULLING OPEN CONTINUOUSLY CROSS-CONVEYED TUBE SECTIONS FOR THE PURPOSE OF FORMING BOTTOMS IN THE MANUFACTURE OF SACKS

BACKGROUND OF THE INVENTION

1. Field of the Invention

This invention pertains to a device for pulling open continuously cross-conveyed tube sections for the purpose of forming bottoms in the manufacture of sacks, with support tubes preferably provided in pairs, each tube of which forms the coupler of two parallel connecting rods seated so as to rotate in a machine frame and is equipped with a row of parallel suction units and with a crank which is connected to a shaft of a parallel connecting rod. The crank has a crank pin supporting a slide ring or a roll which slides in a radial guide attached to a shaft. The shaft of the guide is offset relative to the parallel connecting rod shaft such that an essentially translational movement corresponding to the conveyance speed is superimposed on the opening movement of the row of suction units.

2. Description of Related Art

A device of this type, known from practice, will be described on the basis of FIGS. 4 and 5 of the drawings.

Tube sections 1 of single-ply or multiple-ply paper are conveyed in the direction of arrow 2 lying transversely in the conveyor plane 3 such that the ends of the tube sections to be pulled open, provided with straight cut edges, project over guide or limit edges. The ends of the tube sections formed by the cut edges are pulled open by rows of suction units 4, only one of which is shown, which act on the tube sections. The folding of the opened so-called bottom square is stabilized by blades creasing the fold edges 5 of the corner folds 6, so that in subsequent stations, after the optional insertion of bottom-covering sheets, the bottoms can be added by overlapping folding of the side panels.

The suction units 4 of both rows are pointed towards one another and are radially attached to support tubes 7 which are attached in articulated fashion as couplers, by shafts 21, to the two parallel connecting rods 8,9, which are seated so as to pivot, in a manner not shown, about pivot shafts 10,11 in the machine frame, not shown. A crank 12 which supports a roll 13 at its free end is fastened to the shaft 10 of coupler 8 so that it cannot rotate. The roll 13 is guided in a radial guide 14 of a disk 15 which is rigidly connected to a shaft 16 seated in the machine frame. The shaft 16 is equipped with a drive mechanism which drives the disk 15 in the direction of arrow A. The spacing between the axes of the shafts 10 and 16 is chosen, and the rotational velocity of the disk 15 is matched to the conveyance speed of the tube sections 1, such that the rows of suction units 4 in the position shown in FIG. 4 grip at the marginal areas of the tube section and perform a translational motion in the direction of sack travel which essentially corresponds to the conveyance velocity of the tube section. During a short conveyance path, a transverse motion is superimposed on the translational motion of the suction units because of the motion characteristics of the coupler 7, so that the end sections of the tube section to be opened are pulled open in the manner illustrated in FIG. 5 and the blades for creasing the corner folds 6 can move into the opened tube sections.

During the opening of the tube section ends, a vacuum is fed via the support tube 7 to the suction units by lines, not illustrated, such that in the position shown in FIG. 4 the suction units 4 attract the sack walls and such that, after the desired opening, the vacuum feeding is interrupted, so that the suction units 4 release the opened end areas with as little distortion as possible, By controlling the crank, therefore, the four-jointed system, including parallel connecting rods and a coupler, is rotated such that as uniform a motion as possible is guaranteed during the opening time and, during the remaining part of the rotation of the parallel connecting rods 8,9, an appropriate restoring motion takes place.

Because of the motion characteristic of the guide curve crank drive, however, only an approximate uniformity of motion between the suction units 4 and the tube section 1 can be achieved, so that a distortion-free opening is not guaranteed. This can be accepted at lower conveyance speeds, but at higher conveyance speeds of the tube section, it leads to problems so that malfunctions and tears may occur during the insertion of the blades eliminating or tracing the corner folds.

SUMMARY OF THE INVENTION

The problem addressed by the invention is therefore to create a device of the type mentioned initially that allows an improved opening of the tube section ends even at higher conveyance speeds.

This problem is solved according to the invention by providing a radial guide shaped in a curved form such that the time of uniformity of motion of the suction units and the tube section is lengthened. By an appropriate curved shape of the radial guide, it is possible to lengthen the time of engagement of the suction units on the sack edges to be opened so that a better and, in particular, more uniform opening is achieved and trouble-free insertion and engagement of the blades creasing the corner folds are guaranteed.

According to a special embodiment of the invention, it is provided that, rather than by a crank-guide curve drive, a pivot shaft of a parallel connecting rod is driven by a servomotor which is controlled such that the time of uniform motion of the suction unit and the tube section is lengthened. Controllable servomotors are known in various designs, so that it is merely necessary to provide an appropriate non-uniform driving to the shaft of a parallel connecting rod corresponding to the conveyance velocity of the tube section.

A particular problem during the opening of the end area with the cut edges is that the edge strips to be pulled up are moved out of the conveyance plane at an angle, with the plane of the suction plates maintaining its level and not participating in the pivoting motion. Consequently, these suction plates move at an angle out of the plane of the pulled-up edge strips and undesired bending of the edge strips results.

An additional problem of the invention is therefore to make a distortion-free opening of the edge strips of the tube sections possible.

According to a refinement, for which independent protection is claimed, it is therefore provided that each support tube be housed so as to be rotatable in mountings that are able to pivot on the parallel connecting rods. On the support tube, a radial lever is placed so that it cannot rotate and moves via a slide ring or a roll on a curve rigidly connected to the associated parallel connecting rod. This gives the plane of the suction plates of each row a pivoting motion such that the plane of the suction plates of each row remains essentially parallel to the plane of the edge strips of the tube sections during the opening process. Because, according to the invention, a rotational motion is superimposed on the opening motion of the suction rows, an opening becomes possible in which the edge of the opened edge strip is not pulled out of the plane corresponding to the opening angle. In an ideal case, the edge strips can be opened by the device according to the invention to the point of a complete formation of the bottom square.

BRIEF DESCRIPTION OF THE DRAWINGS

Embodiments of the invention are described below on the basis of the drawings.

DESCRIPTION OF THE PREFERRED EMBODIMENTS

Figure 1:
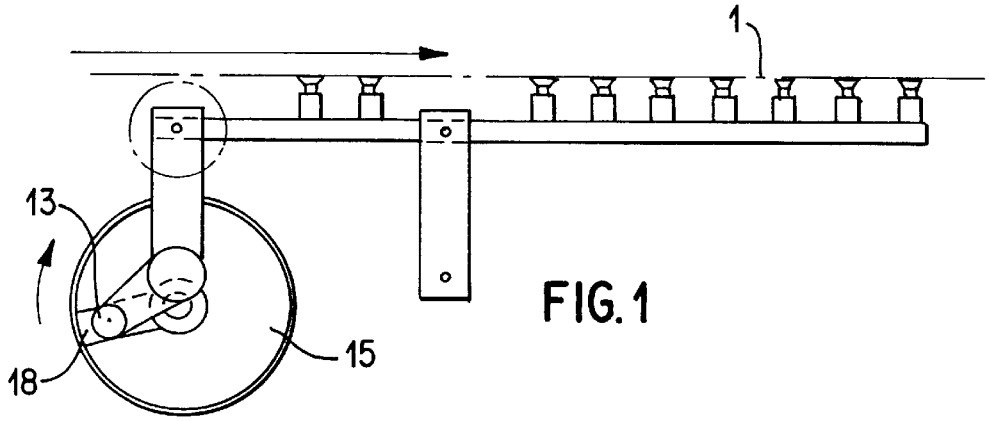
FIG. 1 shows a schematic side view of the opening device according to the invention at the point of attack of the suction units on the edge strip of the tube section still lying flat.
Figure 2:
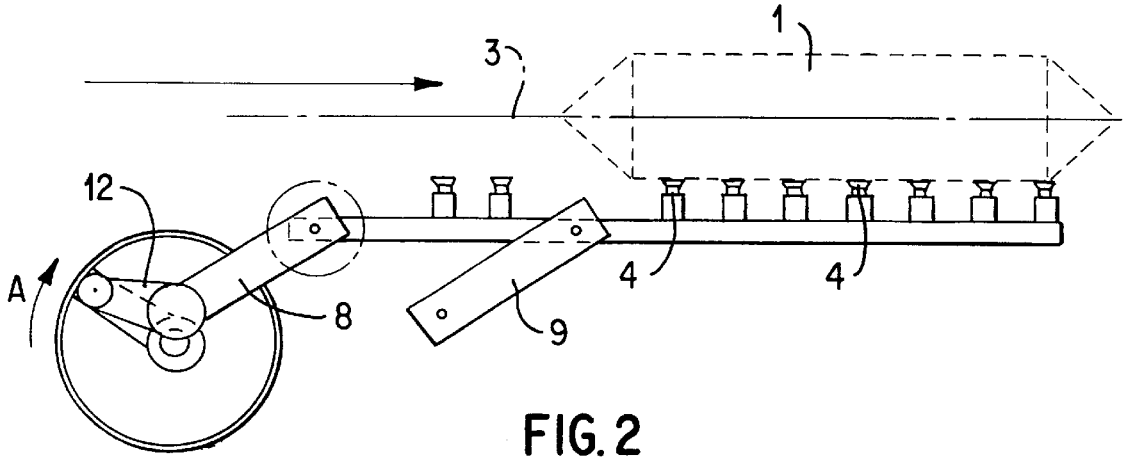
FIG. 2 shows an illustration corresponding to FIG. 1 at a point in time in which the suction units have pulled the edge strips of the tube sections apart.
Figure 4:
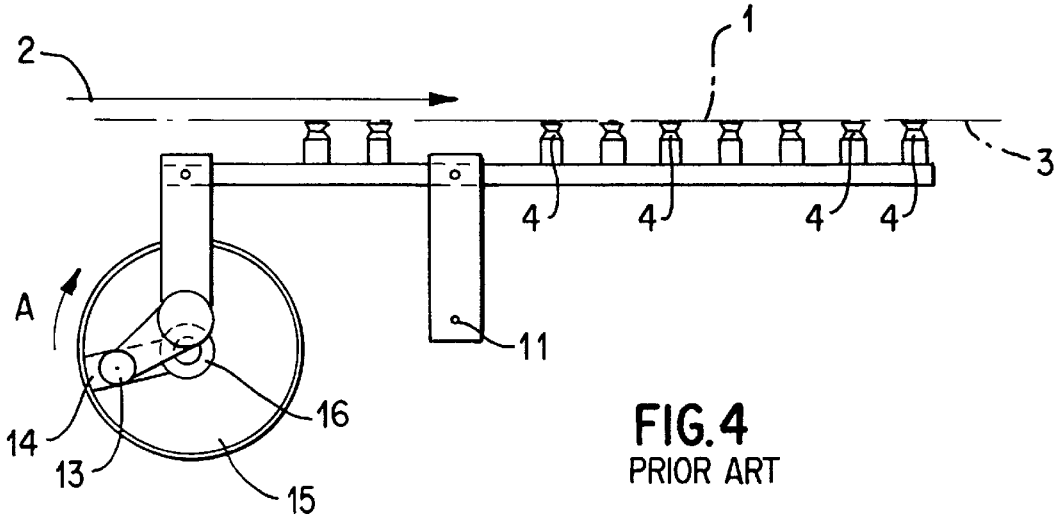
FIG. 4 PRIOR ART
FIGS. 4 & 5 illustrate a conventional opening device.
Figure 5:
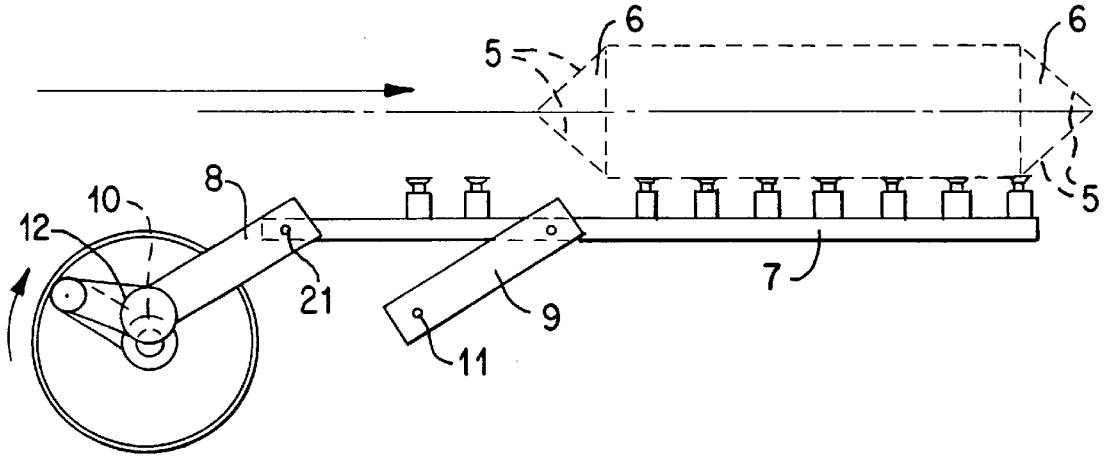
FIG. 5 PRIOR ART

The opening device according to the invention, as shown in FIGS. 1 and 2, essentially corresponds in some ways to the opening device shown in FIGS. 4 and 5, so that reference is made to the description above.

In the opening device according to FIGS. 1 and 2, radially arranged rows of suction units 4, of which only the lower side and the associated drive mechanism are shown in FIGS. 1 and 2, are arranged on the support tube on either side of the conveyance plane 3.

The opening device shown in FIGS. 1 and 2 is distinguished from that according to FIGS. 4 and 5 in that the roll 13, which is seated so as to rotate on the crank pin at the free end of the crank 12, is guided in a guide 18 of the disk 15 which is formed in a curved shape such that the time of uniform motion of the suction units 4 and the tube section 1 is lengthened and thus the time for action is also lengthened.

Figure 3:
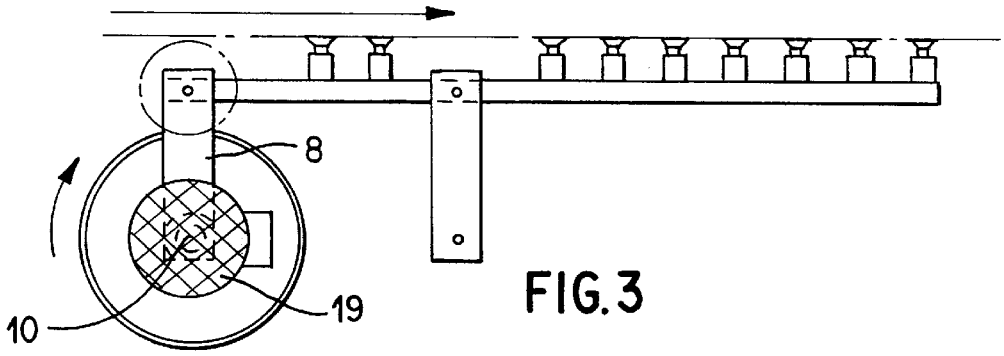
FIG. 3 shows a schematic side view of a second embodiment of the opening device according to the invention.

In the embodiment according to FIG. 3, it is provided that, rather than by a crankguide curve drive, the shaft 10 of the connecting rod 8 seated in the machine frame is driven by a servomotor 19 which is controlled by a control device, not shown, so that the connecting rod rotates such that the time of uniform motion, and thus the time in which the suction units can act on the edge strips of the tube sections to be pulled open, is lengthened.

A particular problem in pulling the edge strips of the tube sections open is that the edge strips are angled off around their folding lines, defined by the outer folding edges, and thus assume an inclined shape with respect to the flat middle plane of the tube section, whereas the plane of the suction plates remains parallel to the middle plane of the tube sections.

Figure 7:
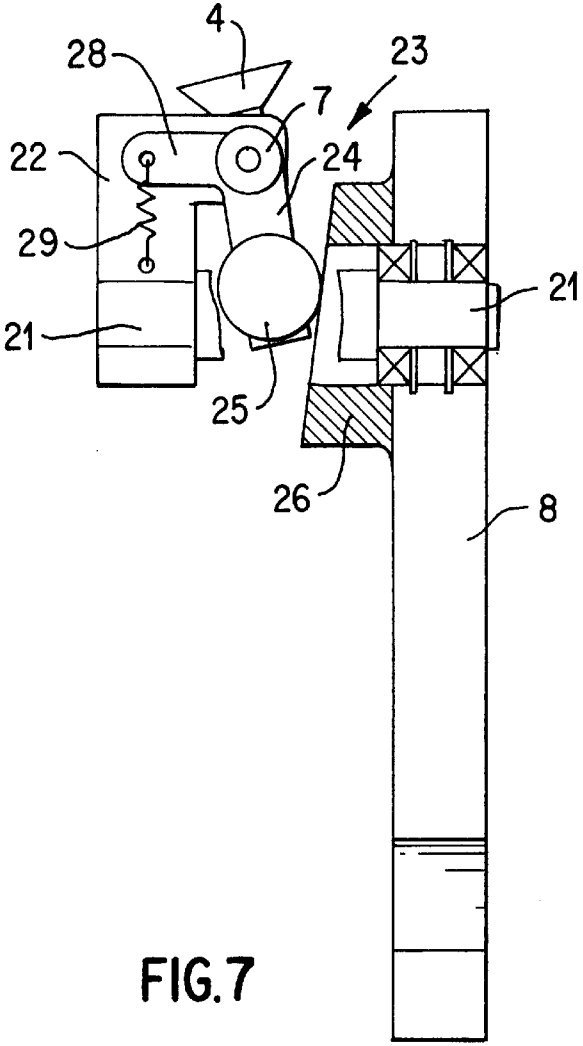
FIG. 7 shows a section through the parallel connecting rod along line VII—VII in FIG. 6.
Figure 6:
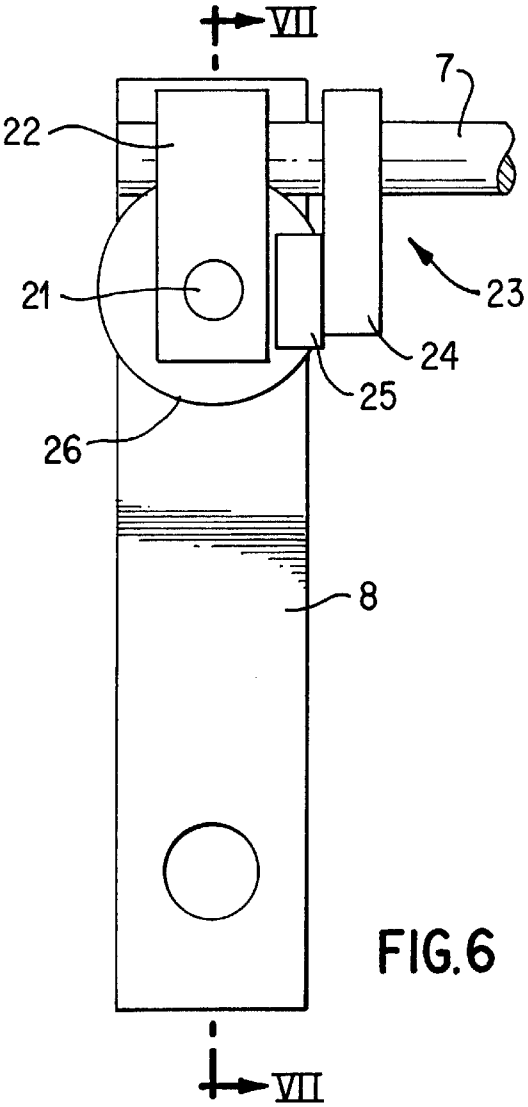
FIG. 6 shows a side view of the left connecting rod of the parallel connecting rod system carrying the support tube with suction units.

In order also to pivot the plane of the suction plates during the opening of the edge strips corresponding to the plane of the opened edge strips, there is a rotation of the support tube 7 due to the design shown in FIGS. 6 and 7, which brings about a pivoting of the suction units 4.

In order to achieve an appropriately controlled rotation, a shaft 21, on which a holder piece 22 is placed so that it cannot rotate, is seated so as to rotate freely in a connecting rod 8 of the parallel connecting rod-support tube system. The support tube 7 is seated so as to rotate freely in the holder piece 22 above the shaft 21 and crossing its axis at a right angle. The support tube 7 is in turn connected to a vacuum source in a manner not shown. An angled lever 23, one of whose arms 24 supports a freely rotating track roller 25, is placed on the support tube 7. This track roll runs over a control curve 26 holding the shaft 21 and is connected to the parallel connecting rod 8. The other lever arm 28 of the angled lever 23 is connected by a tension spring 29 to the support piece 22 such that the track roller 25 is held in contact on the running surface of the curved guide 26. The control curve of the curve guide 26 is shaped such that in the case of a pivoting of the parallel connecting rods, a pivot motion is given to the support tube 7 via the track roller 25 and the lever arm 24 such that the plane of the suction units remains parallel to the angularly folded over edge strips of the tube sections during the time of their engagement with the edge strips and their opening motion.

The other parallel connecting rod is equipped in corresponding manner with a pivoting holder piece in which the support tube 7 is supported so as to rotate. The other parallel connecting rod, however, is not equipped with a lever and track roll that pivot the support tube 7.

What is claimed is:

1. A device for pulling open continuously cross-conveyed tube sections for forming bottoms during manufacture of sacks comprising:

a pair of support tubes connected to vacuum sources by lines, parallel and rotatable connecting rods, each of said support tubes coupling two of said parallel and rotatable connecting rods, a row of radial suction units with which said support tubes are equipped, a crank connected to a shaft of one of said parallel connecting rods, and a roll supported by said crank and sliding in a rotatable radial guide, the guide being offset relative to a rotation axis of the one of said parallel connecting rods such that an essentially translational movement, corresponding to a conveyance speed, is superimposed on opening movement of the row of suction units, wherein the radial guide is formed in a curved shape so as to extend a time of uniform motion of the suction units and the tube sections.

2. A device according to claim 1, wherein a pivot shaft of the one of said parallel connecting rods is driven by a servomotor which is controlled so as to extend the time of uniform motion of the suction unit and the tube sections rather than by the crank, the roll and the radial guide.

3. A device according to claim 1, wherein the support tubes are equipped with devices which twist the latter during an opening motion of the suction units such that planes of the suction units remain parallel to angularly folded over edge strips of the tube sections.

4. A device according to claim 3, wherein each support tube is housed so as to rotate in holder pieces seated on the parallel connecting rods so as to pivot, and a radial lever is placed on the support tube so that it cannot rotate and runs via a roll on a curve firmly connected to said one of said parallel connecting rods, which gives the support tube a pivoting motion such that the plane of the suction plates of each row remains parallel to the angularly folded over edge strips of the tube sections during the opening motion.

5. A device according to claim 2, wherein the support tubes are equipped with devices which twist the latter during an opening motion of the suction units such that planes of the suction units remain parallel to angularly folded over edge strips of the tube sections.

6. A device according to claim 5, wherein each support tube is housed so as to rotate in holder pieces seated on the parallel connecting rods so as to pivot, and a radial lever is placed on the support tube so that it cannot rotate and runs via a roll on a curve firmly connected to said one of said parallel connecting rods, which gives the support tube a pivoting motion such that the plane of the suction plates of each row remains parallel to the angularly folded over edge strips of the tube sections during the opening motion.

* * * * *